United States Patent [19]

Deal

[11] 4,434,943

[45] Mar. 6, 1984

[54] PUMP INTAKE CUTTER HEAD

[76] Inventor: Troy M. Deal, 277 Trismen Ter., Winter Park, Fla. 32789

[21] Appl. No.: 359,432

[22] Filed: Mar. 18, 1982

Related U.S. Application Data

[63] Continuation of Ser. No. 168,145, Jul. 14, 1980, abandoned, which is a continuation of Ser. No. 18,105, Mar. 7, 1979, abandoned.

[51] Int. Cl.[3] ..... B02C 19/12; B02C 23/36

[52] U.S. Cl. ..... 241/46.08; 241/185 A

[58] Field of Search ..... 56/9; 415/121 B; 241/46.06, 55, 46.11, 244, 46.17, 245, 246, 247, 188 R, 185 A, 46.08, 46 R

[56] References Cited

U.S. PATENT DOCUMENTS

| | | | |
|---|---|---|---|
| 756,031 | 3/1904 | Lee . | |
| 2,839,251 | 6/1958 | Hippert | 241/188 R X |
| 3,096,718 | 7/1963 | Anderson | 241/185 A |
| 3,289,720 | 12/1966 | Otto . | |
| 3,749,325 | 7/1973 | Maier . | |
| 4,076,179 | 2/1978 | Tsukube | 241/46.11 |
| 4,104,813 | 8/1978 | Lindsey | 241/46.11 X |

*Primary Examiner*—Mark Rosenbaum

*Attorney, Agent, or Firm*—Beaman & Beaman

[57] ABSTRACT

The present invention relates to improvements in the pumping of a slurry of aquatic growths being removed from lakes, rivers, canals and other waterways wherein final comminuting of the growth takes place directly adjacent the inlet impeller of the pump through the use of one or more static shear or cutting bars disposed in shearing clearance relationship with the impeller with respect to the growths being moved by the impeller and disposed between the bars and surfaces of the impeller.

1 Claim, 2 Drawing Figures

PUMP INTAKE CUTTER HEAD

This is a continuation of application Ser. No. 06/168,145, filed on July 14, 1980 which was a continuation of application Ser. No. 18,105 filed on Mar. 7, 1979, both now abandoned.

BACKGROUND OF THE INVENTION

Lake and wide river infestation by hyacinth, hydrilla and the like requires massive high production eradication involving the pumping of a great volume of water and comminuted aquatic growths in the form of a slurry. To be economically performed with a minimum of impact upon the adjacent environment it is necessary that the transfer of the slurry to remote areas be carried out without clogging of the transfer equipment.

U.S. Pat. No. 3,862,537 provides an extensive disclosure of the state of the art to which the present invention relates. This patent is of particular interest as disclosing a final comminuting operation taking place on the discharge side of the pumping system.

Reference should be made to U.S. Pat. Nos. 3,096,718 and 4,104,813 as disclosing cutter head structure applied to pumps.

SUMMARY OF THE INVENTION

The basic principle of the invention is shown illustrated in connection with a conventional form of suction pump in which the impeller has been caused to carry out a comminuting operation by placing one or more static shear or cutting bars adjacent to rotating surfaces of the impeller to shear lengths of aquatic growths being moved through the pump by the rotation of the impeller. The bars or their equivalent may be located on either the suction or pressure side of the impeller or both. When used on the suction side of the impeller, equally spacing a plurality of the bars within the intake chamber of the impeller will act to screen objects that would be injurious to the impeller.

DESCRIPTION OF THE PREFERRED EMBODIMENT

Figure 1:
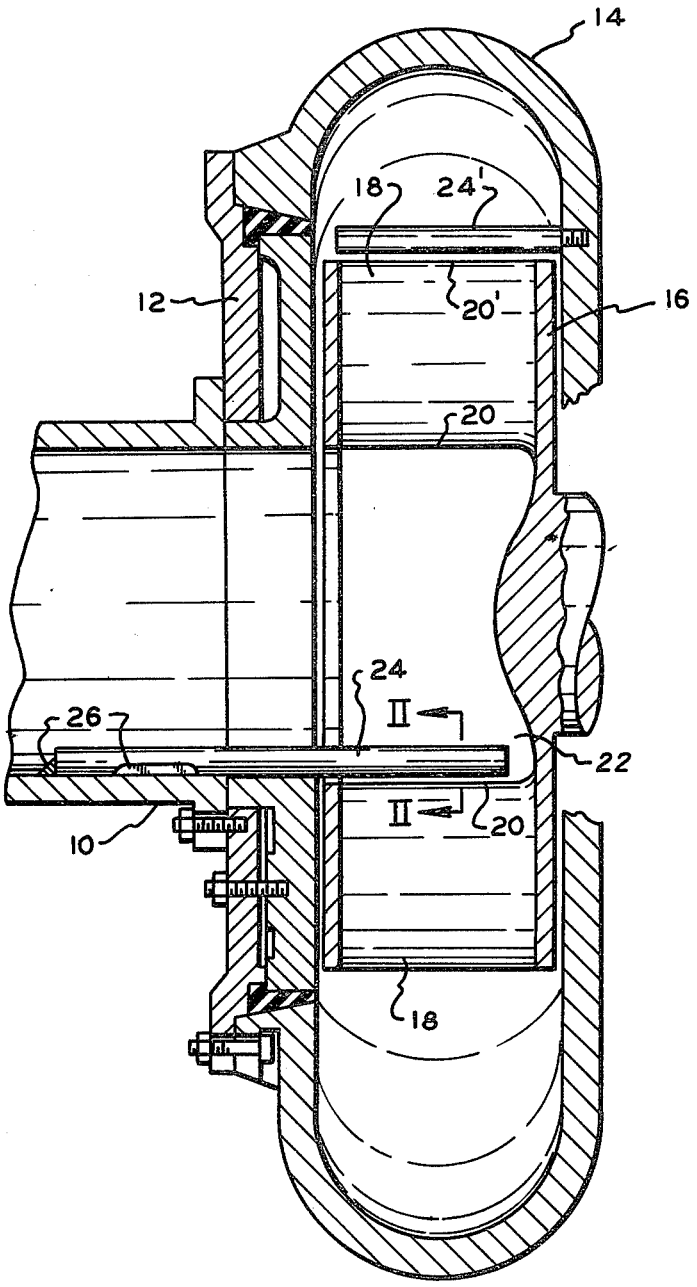
FIG. 1 is a fragmentary vertical cross sectional view of a conventional suction pump in which the shear bars of the invention are shown employed.

The suction pipe 10 is shown attached to the suction adapter 12 of the pump housing 14 in which the usual impeller 16 is supported for rotation. The usual radial passages 18 of the impeller 16 have surfaces 20 adjacent the axes of rotation which define the annular intake chamber 22. At the outer end of the passages 18 surfaces 20' define the outer annular shape of the impeller 16.

To provide the impeller 16 with a comminuting function with respect to aquatic being moved through the pump housing 14 by rotation of the impeller in the usual manner, it is provided that one or more static shear or cutter elements of suitable size and shape be supported adjacent the surfaces 20 and 20' in shearing relation to the aquatic growths passing through the pump. As illustrated a bar 24 is shown welded at 26 to the pipe 10 and axially projecting into the intake chamber 22 of the impeller 16. If desired the bar 24 may be welded or otherwise affixed to the adapter 12. In either case, the projected outer end of the bar 24 will be disposed adjacent the surfaces 20 which define the annular intake chamber 22 as well as the inner terminal of the passages 18. In this manner, the outer end of the bar 24 is disposed in shearing relation with respect to the surfaces 20 and the passages of aquatic growths entering the passages 18 during rotation of the impeller 16.

A shear bar 24' is shown supported from the housing in shearing relation to the surfaces 20' defining the outer annular shape of the impeller 16 as well as the outer terminal of the passages 18. As shown, the bar 20' has a threaded end engaging in a threaded aperature in the housing 14. As lengths of aquatic growths pass radially through the passages 18 of the impeller 16 they will be carried into a shearing zone provided by surfaces 20'. The amount of comminuting of the aquatic growths taking place at opposite ends of the passages 18 during rotation will depend upon the number of bars 24 and 24' installed. For example a second bar may be affixed to the pipe 10 diametrically opposite the bar 24 shown in FIG. 1.

Figure 2:
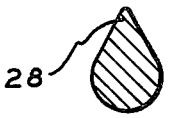
FIG. 2 is a cross sectional view taken on line II—II of FIG. 1 of the shear bar supported on the suction pipe and axially projecting into the intake chamber of the impeller.

As indicated above the bars 24 and 24' may be of any suitable shape and material. If provided with a cutting edge 28 as shown in FIG. 2, the edge should be directed upstream as the lengths of aquatic growths will tend to drape over the edge 28 as the suction draws the lengths in the slurry through the passages 18.

It will be understood that the clearance between the bars 24 and 24', and the surfaces 20 and 20', is a close running clearance capable of shearing the lengths of aquatic growths without interferring with the rotation of the impeller 16. Obviously the use of the bars 24 and 24' will increase the power input to the pump required to handle the same volume of slurry.

I claim:

1. In combination with a centrifugal liquid pump for transferring and comminuting a slurry including aquatic growths wherein the pump includes a rotatable impeller having structure defining radial passages and radial passage inlets, a suction pipe having a passage having upper and lower internal portions, connection means releasably attaching said suction pipe to said pump, said pump having its axis of impeller rotation aligned with said pipe, a cylindrical intake chamber defined by the radial passages of said pump aligned with said pipe passage, a static shear element in the form of an elongated cantilevered bar mounted at one end upon said pipe with its other end projecting substantially into said chamber adjacent the pump passage inlets in shear relation with the structure defining said passages and passages' inlets, said bar being located in the lower interior portion of said pipe and chamber wherein the density of said slurry due to the effect of gravity is the greatest.

* * * * *